United States Patent [19]

Fujiwara et al.

[11] Patent Number: 4,560,333

[45] Date of Patent: Dec. 24, 1985

[54] SCREW COMPRESSOR

[75] Inventors: Mitsuru Fujiwara, Ibaraki; Taisuke Torigoe, Atsugi, both of Japan

[73] Assignee: Hitachi, Ltd., Tokyo, Japan

[21] Appl. No.: 577,814

[22] Filed: Feb. 7, 1984

[51] Int. Cl.[4] ..... F04C 25/00

[52] U.S. Cl. ..... 418/180; 418/189; 418/201

[58] Field of Search ..... 418/75, 78, 79, 180, 418/189, 190, 201

[56] References Cited

U.S. PATENT DOCUMENTS

| | | | |
|---|---|---|---|
| 2,540,235 | 2/1951 | Berkley | 418/189 |
| 3,057,543 | 10/1962 | Marsden | 418/189 |
| 3,423,017 | 1/1969 | Schibbye | 418/201 |
| 3,874,828 | 4/1975 | Herschler | 418/201 |

OTHER PUBLICATIONS

Japanese Laid Open Application No. 58-214693, Dec. 1983.

*Primary Examiner*—Leonard E. Smith
*Assistant Examiner*—Jane E. Obee
*Attorney, Agent, or Firm*—Antonelli, Terry & Wands

[57] ABSTRACT

A screw compressor having a recess formed in the high-pressure end surface of the casing. This recess receives the fluid from a closed working space which has just been isolated from the discharge port and closed in the compression step. Consequently, the abnormal pressure rise in the closed working space, which is caused due to the compression of the fluid confined, is completely eliminated. The recess has a configuration involving a curve conforming with the leading flank of the female rotor at the instant at which the working space is isolated from the discharge port and closed.

10 Claims, 5 Drawing Figures

SCREW COMPRESSOR

BACKGROUND OF THE INVENTION

1. FIELD OF THE INVENTION

The present invention relates to a screw compressor for use as an air compressor or a refrigerant compressor of an air conditioner or refrigerator. More particularly, the invention is concerned with an oil flooded screw compressor.

2. DESCRIPTION OF THE PRIOR ART

In general, a screw compressor is constituted by parts such as a casing having two intersecting bores with parallel axes, and a male rotor and a female rotor disposed in these bores so as to mesh with each other. In operation, as these rotors are driven by a suitable driving means, air or a refrigerant gas is sucked from a suction port formed in the casing into the working space defined by these rotors and the casing. The air or gas is then compressed in the working space to a higher pressure and is discharged through a discharge port formed in the casing.

The construction and operation of the screw compressor of the kind described are well known and are shown, for example, in the specification of the U.S. Pat. No. 3,423,017.

This oil flooded screw compressor, however, involves some disadvantages as will be explained hereinbelow with reference to the U.S. Pat. No. 3,423,017.

When the male and female rotors take positions as shown in FIG. 5*b* attached to the U.S. Pat. No. 3,423,017, both rotors make mutual contact theoretically at three points 74, 66 and 82. Usually, slight clearances are formed between the rotors in order to ensure a smooth rotation of these rotors while avoiding leak of the fluid through these clearances. In the meshing regions of these rotors, spaces 78 and 76 having ends defined by the contact points 74, 66 and 66, 82 are formed respectively. One 78 of these spaces has a channel form with its volume increasing with the rotation of the rotor. This space 78 is communicated at the other end of the rotor with a suction chamber (not shown), as will be seen from FIGS. 5*b*, 5*c* and 5*d* of the U.S. Pat. No. 3,423,017.

The other space 76 has a channel form with a decreasing volume, and is surrounded by the surfaces of lobes of both rotors. This space is shielded from the outside except for the end portions of the rotor. In the state shown in FIG. 5*b*, the space 78 is communicated with the suction chamber. Therefore, any leak of the compressed gas of high pressure into this space 78 leads to a loss of the compressed gas. Therefore, the discharge port 36 shown by one-dot-and-dash line in FIG. 5*b* has to be positioned so as not to communicate with the space 78.

On the other hand, in order to decrease the discharge loss, there is a demand for increasing the area of the discharge port 36 as much as possible.

In order to compromise these two requirements which are generally incompatible, a baffle means is provided at the center of the discharge port 36. Usually, this baffle means has a contour which conforms with the locus of the contact point 74 and the locus of the contact point 66.

According to this arrangement, in the period of rotation of the rotors from the position shown in FIG. 5*b* to the position shown in FIG. 5*c*, the space 76 is isolated from the discharge port 36 and is closed completely.

Since the volume of this closed space is decreased with the rotation of the rotors, the fluid confined in this closed space is over compressed to an abnormally high pressure. This causes not only noise and vibration of the rotor but burdens the rotors excessively, often resulting in a breakdown of the rotor and/or shortening of the life of the bearings.

In the described prior art shown in the U.S. Pat. No. 3,423,017, in order to avoid the confinement of the fluid into the closed space 76, recesses 106 and 108 are provided at the crests of the lobes as shown in FIGS. 6 and 7*a* to 7*d*. These recesses 106 and 108 are somewhat effective in eliminating the confinement of the fluid. It is, however, not allowed to increase the sizes of these recesses unlimitedly for the following reason. Namely, if the recess is formed at the crests of the lobe, the fluid leaks through this recess even in other than the period in which the confinement takes place. This obviously causes a serious loss of compressed fluid. Thus, the size of the recesses 106, 108 is naturally limited. The provision of the recess at the crest of the lobe is not preferred also from the view point of productivity, because the life of the manufacturing tool is shortened due to the complicated configuration of the lobe crest.

Japanese Patent Laid-Open No. 58-214693 also proposes a solution to the problem incurred by the closed space 76. This solution, however, is still unsatisfactory in that the pressure rise in the space 76 cannot be prevented perfectly because the closed space 76 is allowed to be communication with the low-pressure side only gradually with the rotation of the rotors.

SUMMARY OF THE INVENTION

Accordingly, an object of this invention is to provide a screw compressor improved to avoid over compression in a closed working space with rotation of rotor, the closed working space is formed after the working space defined by a casing and a pair of rotors is isolated from the discharge port during discharging phase.

Another object of the invention is to provide a screw compressor improved to suppress noise and vibration or to avoid generation of noise and vibration which may be caused by the over compression in the closed working space.

To attain these objects, the present invention is characterized in that a recess is provided at the wall of discharge side of the casing, the recess being communicated with the closed working space which is formed just after the working space is isolated from the discharge port, and the profile of the recess perpendicular to the rotor axes includes a curve substantially conforming with the leading flank of the female rotor in the state just when the closed working space is formed.

These and other objects, features and advantages of the invention will become clear from the following description of the preferred embodiments taken in conjunction with the accompanying drawings.

DESCRIPTION OF THE PREFERRED EMBODIMENTS

Figure 1:
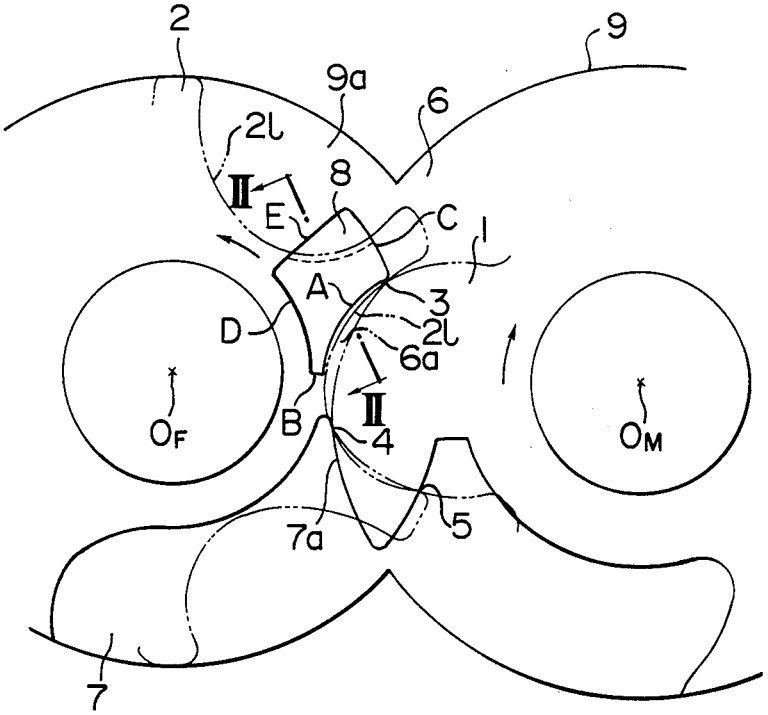
FIG. 1 is an elevational view of the dischargeside end surface of the casing of a screw compressor taken along a plane perpendicular to the axis of the casing.

FIG. 1 shows the state of meshing of two rotors when a selected one of the working spaces is isolated from the discharge port.

Figure 2:
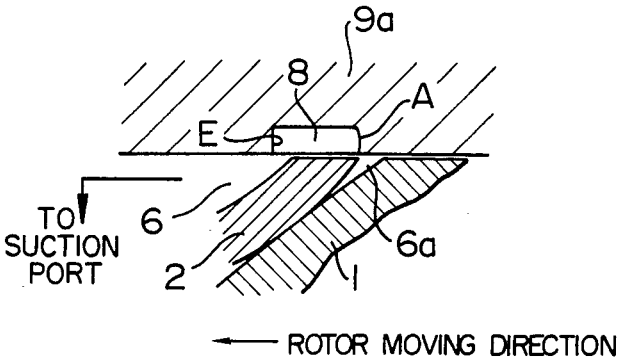
FIG. 2 is a sectional view taken along the line II—II of FIG. 1.

Referring to FIGS. 1 and 2, a screw compressor in accordance with the invention has a male rotor 1 and a female rotor 2 arranged in a pair and disposed in intersecting bores with parallel axes formed in a casing 9 so as to mesh with each other. In a plane containing the discharge-side end surface 9*a* of the casing 9, both rotors 1 and 2 make theoretical contact with each other at three points 3, 4 and 5. A reference numeral 6*a* designates a closed working space formed between the rotors 1 and 2. The working space is being contracted and has been isolated from the discharge port 7. When the rotors 1 and 2 take positions as shown in FIG. 1, the closed working space 6*a* is spaced apart from the edge 7*a* of the discharge port 7. A recess 8 is formed in the discharge-side end surface 9*a* of the casing 9. As will be seen from this Figure, the recess 8 is opened to a working space 6 of the low-pressure side. The recess 8 has a configuration defined by curves A, B, C, D and E which are connected one to another. Among these curves, the curve A is the most significant one. Namely, this curve A substantially conforms with the leading flank 2l of the female rotor 2 facing the closed working space 6*a* formed just when an arbitrarily selected working space is isolated from the discharge port. In addition, the length of the curve A is more than a half of the length along the flank of the teeth in the closed space 6*a*, namely the length between the points 3 and 4. The junction between the curves A and C coincides with one 3 of contact points between the rotors 1 and 2. The curve B extends along a straight line extending between the axes $O_M$ and $O_F$ of both rotors 1 and 2. The curve D is an arc along the locus of rotation of the root of the female rotor 2. Curves C and E are suitably selected to permit the recess 8 to be communicated with the working space 6 of the low-pressure side.

Other points of the construction and compressing motion of the screw compressor than those specifically mentioned above are the same as those shown in the U.S. Pat. No. 3,423,017 and, hence, are not described in this specification. The profile of the male rotor 1 and the female rotor 2 will be understood referring to the above-mentioned U.S. patent. Likewise, the suction port of the type shown in U.S. Pat. No. 3,423,017 is shown schematically in FIG. 2 by the arrow indicating the communication from the suction port on the low pressure side directed toward the working space 6.

The operation of this screw compressor is as follows. When the rotors are slightly rotated from the state shown in FIG. 1, namely the state at which an arbitrarily selected working space is isolated from the discharge port 7, the closed working space 6*a* and the recess 8 are communicated with each other over the entire length of the curve A determining a part of the configuration of the recess 8. As a result, the oil or gas which have come into the closed working space 7*a* is discharged at a stroke and rapidly so that the undesirable over compression in the closed working space 7*a* is prevented even if the volume of the closed working space 7*a* is decreased with the rotation of both rotors 1 and 2.

The above-explained operation will be more fully described hereinbelow with reference to FIGS. 4 and 5.

Figure 4:
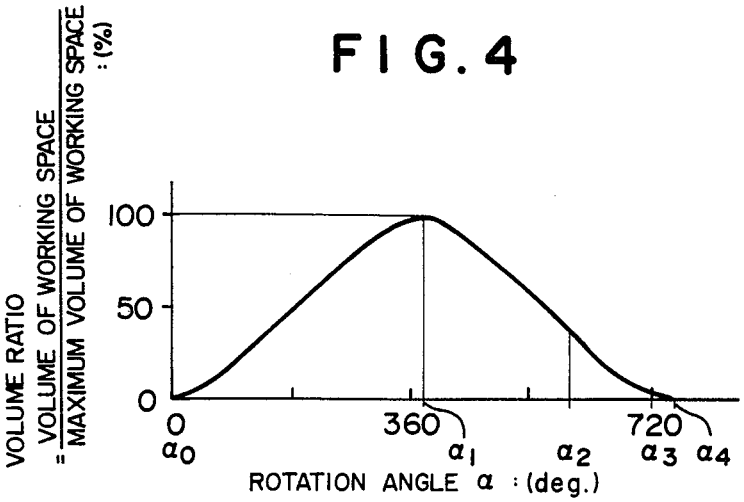
FIG. 4 is a graph showing how the volume in the working space is changed in relation to the angle of rotation of the rotor.
Figure 5:
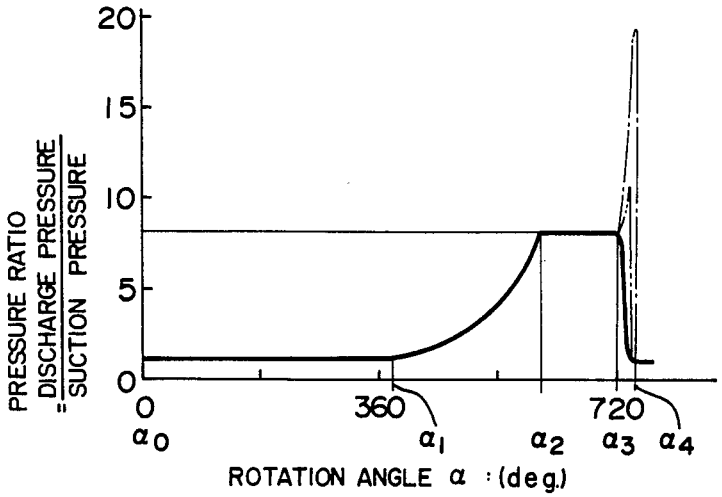
FIG. 5 is a graph showing how the pressure in the working space is changed in relation to the angle of rotation of the rotor.

FIGS. 4 and 5 show, respectively, how the volume and pressure of each working space are changed with the rotation of the rotors. In these Figures, the full-line curve shows the characteristic of the compressor in accordance with the invention, while one-dot-and-dash line and two-dots-and-dash line show the characteristics of the prior arts.

Referring to FIGS. 4 and 5, the volume V of the arbitrarily selected working space is increased in the period between the rotation angle $\alpha_o$ and $\alpha_1$. In this period, this working space is communicated with the suction port so that the gas can be introduced into the working space through the suction port. At the moment at which the rotation angle is $\alpha_1$, the working space has its maximum volume and is isolated from the suction port simultaneously. The period between the rotation angle $\alpha_1$ and $\alpha_2$ is the compression phase in which the volume of the working space is decreased with the rotation of the rotor. Consequently, the gas pressure in the working space is increased in this period.

At the moment at which the rotation angle is $\alpha_2$, the working space is brought into communication with the discharge port, so that the gas is discharged from the working space through the discharge port in the period between the angle $\alpha_2$ and the angle $\alpha_3$ with the rotation of the rotors. The gas pressure is maintained substantially constant in this period of between the rotation angles $\alpha_2$ and $\alpha_3$.

Then, as the rotation angle $\alpha_3$ is reached, the working space is isolated from the discharge port and is completely closed. A further slight rotation from the rotation angle $\alpha_3$ allows the closed working space to be communicated with the recess and, at this moment, the oil or the gas which has come into this closed working space are discharged into the recess at a stroke. Consequently, it is possible to avoid any over compression while the both rotors rotate to the rotation angle $\alpha_4$, which is the same as the angle $\alpha_o$.

As has been described, according to this invention, it is possible to eliminate the abnormal pressure rise in the closed working space when the closed working space is contracted with the rotation of the rotors after being isolated from the discharge port. The one-dot-and-dash line curve and two-dots-and-dash line curve in FIG. 5 show the pressure changes in relation to the rotation angle of the prior art screw compressors. In these prior arts, the over compression is caused just after the moment of the rotation angle $\alpha_3$ at which the closed working space is formed.

Figure 3:
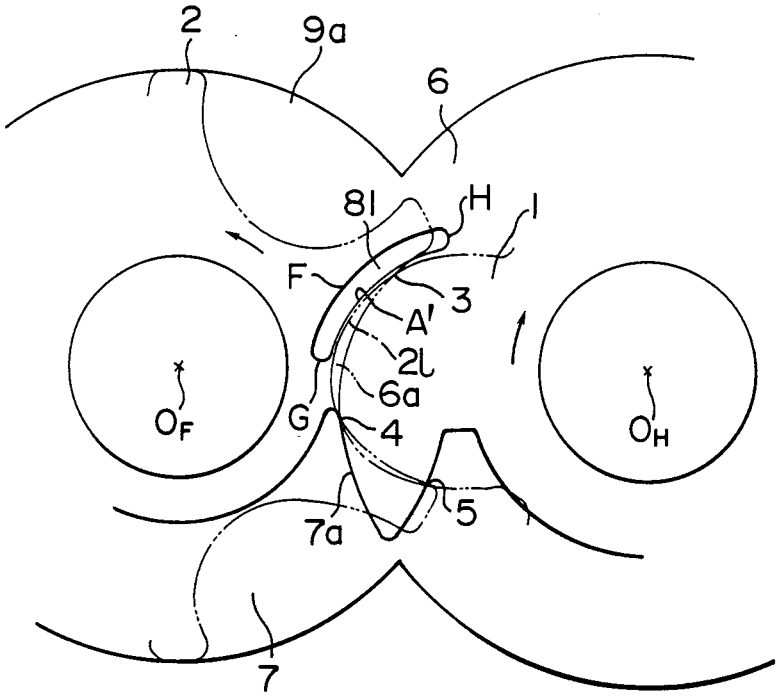
FIG. 3 is an elevational view of the dischargeside end surface of the casing of another embodiment of the compressor as viewed in the plane perpendicular to the axis of the casing.

FIG. 3 shows another embodiment of the screw compressor of the present invention. In this embodiment, the recess 81 is defined by a curve A′ which extends substantially along the leading flank 2l of the groove of the female rotor 2 facing to the closed working space 6*a*, a curve F spaced apart by a constant distance from the curve A′, and arcs G and H through which both curves A′ and F′ are connected to each other. In this embodiment of the invention, the recess 81 can be formed simply by moving the end mill cutter along the curve of the leading flank 2l of the female rotor 2.

In the embodiments described hereinbefore, the recess 8 or 81 is configurated such that, in the state which the closed working space is communicated with the recess 8 or 81, i.e. in the state as shown in FIGS. 1 to 3, a part of the recess 8 or 81 is allowed to communicate with the suction side. This, however, is not exclusive and the recess 8 or 81 may be so shaped as not to communicate with the suction side. For instance, such a form of recess can modify parts of the curves C, E shown in FIG. 1 in a manner as indicated by the broken lines. In such a modification, it is necessary to make the volume of the recess be greater than that of the closed space *7a*.

Although the invention has been described through specific terms, it is to be noted that the described embodiments are not exclusive and various further changes and modifications may be imparted thereto without departing from the scope of the invention which is limited solely by the appended claims.

What is claimed is:

1. A screw compressor comprising a casing having two intersecting bores with parallel axes, a suction port and a discharge port communicating with said bores, respectively, and a pair of screw rotors, one male and one female, received in said bores so as to rotate in meshing relationship to suck gas from the suction port into a working space defined by said rotors and said casing, to compress the gas and then to discharge the gas through the discharge port;

wherein the improvement comprises a discharge side end surface of said casing having a recess formed thereon so as to open in the bores, said recess having a configuration, in the plane perpendicular to the axes of said rotors, which includes a curve which conforms with a leading edge of the female rotor facing a closed working spaced formed between said rotors just as the working space is isolated from the discharge port.

2. A screw compressor as claimed in claim 1, wherein said curve of said configuration of said recess substantially conforming with said leading edge of said female rotor has a length which is more than a half of the length along the edge of said female rotor in said closed working space.

3. A screw compressor as claimed in claim 1, wherein said recess has a volume which is greater than the volume of the closed working space formed when said working spaced is isolated from said discharge port.

4. A screw compressor as claimed in claim 1, wherein said recess includes a second curve which is spaced apart by a constant distance from said first curve and most part of the configuration of said recess has an elongate form curved substantially in conformity with said leading edge of said female rotor.

5. A screw compressor as claimed in claim 1, wherein the configuration of said recess is defined by curves and includes a straight line which coincides with a part of a straight line connecting both axes of said male rotor and said female rotor.

6. A screw compressor as claimed in claim 1, wherein said recess is formed to have such a configuration that the opening of said recess facing a high-pressure side end surface of said female rotor is closed by said high-pressure side end surface of said female rotor when the closed working space isolated from said discharge port is communicated with said recess.

7. A screw compressor as claimed in claim 6, wherein said recess has a volume greater than that of the closed working space formed when said working spaced is isolated from said discharge port.

8. A screw compressor as claimed in claim 1, wherein said recess is formed to have such a configuration that said recess is communicated with another working space which is in suction phase when said closed working space isolated from said discharge port is communicated with said recess.

9. A screw compressor as claimed in claim 8, wherein said curve has a length which is more than half of the length along said edge of said female rotor in the closed working space.

10. A screw compressor as claimed in claim 8, wherein said recess includes a second curve which is spaced apart by a constant distance from said first curve and most part of the configuration of said recess has an elongate form curved substantially in conformity with said leading edge of said female rotor.

* * * * *